US005732770A

United States Patent [19]

Beeman

[11] Patent Number: 5,732,770

[45] Date of Patent: Mar. 31, 1998

[54] WELLBORE CUTTER

[75] Inventor: Robert Beeman, Bossier City, Calif.

[73] Assignee: Weatherford/Lamb, Inc., Houston, Tex.

[21] Appl. No.: 693,470

[22] Filed: Aug. 2, 1996

[51] Int. Cl.[6] ..... E21B 29/00

[52] U.S. Cl. ..... 166/55.8

[58] Field of Search ..... 166/55.8, 55.7, 166/55.6

[56] References Cited

U.S. PATENT DOCUMENTS

| | | | |
|---|---|---|---|
| 2,215,632 | 9/1940 | Brack et al. . | |
| 2,322,695 | 6/1943 | Kinzbach | 166/55.8 |
| 2,353,284 | 7/1944 | Barrett | 166/55.8 |
| 2,859,943 | 11/1958 | Chedderdon . | |
| 2,899,000 | 8/1959 | Medders et al. | 166/55.8 |
| 3,195,636 | 7/1965 | Cordary et al. . | |
| 3,331,439 | 7/1967 | Sandord . | |
| 3,386,521 | 6/1968 | Chadderdon et al. . | |
| 3,419,077 | 12/1968 | Sanford . | |
| 4,003,433 | 1/1977 | Goins | 166/55.8 |
| 4,047,568 | 9/1977 | Aulenbacher | 166/298 |
| 4,068,711 | 1/1978 | Aulenbacher | 166/55.3 |
| 4,119,151 | 10/1978 | Smith | 166/298 |
| 4,191,255 | 3/1980 | Rives | 166/297 |
| 4,618,009 | 10/1986 | Carter et al. | 175/267 |
| 4,646,826 | 3/1987 | Bailey et al. | 166/55.3 |
| 4,710,074 | 12/1987 | Springer | 408/200 |
| 4,717,290 | 1/1988 | Reynolds et al. | 407/34 |
| 4,776,394 | 10/1988 | Lynde et al. | 166/55.8 |
| 4,887,668 | 12/1989 | Lynde et al. | 166/55.8 |
| 4,889,197 | 12/1989 | Boe | 175/267 |
| 4,893,675 | 1/1990 | Skipper | 166/55.8 |
| 4,938,291 | 7/1990 | Lynde et al. | 166/55.8 |
| 5,010,955 | 4/1991 | Springer | 166/298 |
| 5,012,863 | 5/1991 | Springer | 166/55.7 |
| 5,036,921 | 8/1991 | Pittard et al. | 166/298 |
| 5,060,738 | 10/1991 | Pittard et al. | 175/267 |
| 5,074,356 | 12/1991 | Neff | 166/55.7 |
| 5,150,755 | 9/1992 | Cassel et al. | 166/297 |
| 5,253,710 | 10/1993 | Carter et al. | 166/298 |
| 5,265,675 | 11/1993 | Hearn et al. | 166/55.8 X |
| 5,318,115 | 6/1994 | Rouse | 166/55.7 |
| 5,456,312 | 10/1995 | Lynde et al. | 166/55.6 |

OTHER PUBLICATIONS

"Oilfield Services And Manufactured Products 1984–85 Catalog," Homoco Int'l Inc., 1984.

"General Catalog 1982/1983," Servco Div. of Smith Int'l, 1982.

"1990–91 General Catalog," A–1 Bit & Tool Co., 1990, pp. 3, 4, 7, 10, 11, 14.

*Primary Examiner*—Hoang C. Dang

*Attorney, Agent, or Firm*—Guy McClung

[57] ABSTRACT

A new wellbore cutter has been invented which, in certain embodiments has a piston having a fluid flow bore therethrough, at least one stabilizer kick-out member, and at least one cutting blade kick-out member, an outer body through which the piston projects, the outer body movable about the piston, the outer body having at least one stabilizer pivotably mounted thereto, the at least one stabilizer movable out from the outer body upon movement of the outer body with respect to the piston so that the at least one stabilizer contacts the at least one stabilizer kick-out member, said contact effecting extension of the at least one stabilizer out from the outer body, and the outer body having at least one cutting blade pivotably mounted thereto, the at least one cutting blade movable out from the outer body upon movement of the outer body with respect to the piston so that the at least one cutting blade contacts the at least one cutting blade kick-out member, said contact effecting extension of the at least one cutting blade out from the outer body. In one aspect the at least one stabilizer is extended prior to cutting by the at least one cutting blade. The stabilizer(s) and cutting element(s) or blade(s) can be retracted by pulling on the piston or by reducing fluid pressure.

16 Claims, 2 Drawing Sheets

WELLBORE CUTTER

BACKGROUND OF THE INVENTION

1. Field of the Invention

The present invention is directed to wellbore cutting tools and, in one particular aspect, to a "through tubing" cutter for cutting down hole tubulars, e.g. tubing (e.g. production tubing), casing, and drill pipe.

2. Description of Related Art

Certain existing tubular cutters have cutting elements that extend from a tool that is not centralized in a tubular to be cut. This results in poor cutting, off-center cutting, an uneven wear on cutting elements such as cutting blades. These problems are exacerbated when the cutter must pass through a relatively narrow inner diameter tubular prior to positioning in another tubular of wider inner diameter which is to be cut.

SUMMARY OF THE PRESENT INVENTION

The present invention, in one embodiment, discloses a through-tubing cutter for cutting a tubular, the cutter with a central piston about which and with respect to which an outer body moves up in response to increased fluid pressure against the force of a spring that urges the outer body downwardly. As the outer body moves up, one or more stabilizers and one or more cutting elements or cutting blades are moved outwardly by contacting and moving on kick-out members on the central piston. In one aspect the kick-out members for the stabilizer(s) and for the blade(s) are disposed so that the stabilizer(s) extend first to insure good centralizing of the cutter in the tubular to be cut, and then the blade(s) are extended. The stabilizers may be at substantially the same longitudinal location on the cutter or they may be at different levels. The cutting blades may be at substantially the same longitudinal location on the tool or they may be at different levels.

The blade(s) and stabilizer(s) are retracted by decreasing fluid pressure so the spring pushes the outer body down with respect to the piston. In the event such a method of blade retraction fails or is impeded, pulling up on the piston (which, in one aspect, is interconnected with coiled tubing extending to the surface) assists the spring or alone provides for stabilizer and blade retraction.

The cutter may be rotated by a downhole motor interconnected with the cutter or it may be rotated by a top sub or crossover sub which itself is rotated. Such a cutter may be used in snubbing operations. A vibration absorber, e.g. an expansion joint, may be used between a downhole motor and the cutter.

The stabilizers may be hardfaced. The cutting blades may be dressed completely or partially with any known matrix milling material, hardfacing, or inserts, with or without one or more chipbreakers or chipbreaking surfaces.

The present invention, in certain embodiments, discloses a wellbore cutting tool with a body member, at least one stabilizer pivotably mounted on the body member for movement outwardly therefrom to stabilize the wellbore cutting tool in a tubular member, at least one cutting blade pivotably mounted on the body member for movement outwardly therefrom to cut the tubular member, and movement apparatus for moving the at least one stabilizer into a stabilizing position prior to movement of the at least one cutting blade into a position for cutting the tubular member; such a wellbore cutting tool wherein the at least one stabilizer is three spaced-apart stabilizers; such a wellbore cutting tool wherein the at least one cutting blade is three spaced-apart cutting blades; such a wellbore cutting tool suitable for use as a through-tubing cutting tool, the wellbore cutting tool having an outside diameter of 3.75 inches or less; such a wellbore cutting tool with a piston having a fluid flow bore therethrough, at least one stabilizer kick-out member, and at least one cutting blade kick-out member, an outer body through which the piston projects, the outer body movable about the piston, the outer body having at least one stabilizer pivotably mounted thereto, the at least one stabilizer movable out from the outer body upon movement of the outer body with respect to the piston so that the at least one stabilizer contacts the at least one stabilizer kick-out member, said contact effecting extension of the at least one stabilizer out from the outer body, and the outer body having at least one cutting blade for cutting a tubular member in which the wellbore cutting tool is positionable, the at least one cutting blade pivotably mounted to the outer body, the at least one cutting blade movable out from the outer body upon movement of the outer body with respect to the piston so that the at least one cutting blade contacts the at least one cutting blade kick-out member, said contact effecting extension of the at least one cutting blade out from the outer body; such a wellbore cutting tool wherein the at least one stabilizer is three spaced-apart stabilizers, and the at least one cutting blade is three spaced-apart cutting blades; such a wellbore cutting tool with at least one wash port through the piston adjacent each blade of the at least one cutting blade for directing fluid at said blade; such a wellbore cutting tool wherein the at least one stabilizer kick-out member is positioned so that the at least one stabilizer extends from the outer body prior to cutting of the tubular member; such a wellbore cutting tool with a spring with a spring force biasing apart the piston and the outer body so that initially the outer body is prevented from moving with respect to the piston; such a wellbore cutting tool with a pressure chamber between a lower end of the piston and a lower end of the outer body, the pressure chamber in fluid communication with the fluid flow bore through the piston so that fluid under pressure is introducible into the pressure chamber at a pressure that overcomes the spring's spring force, the fluid under pressure acting on a portion of the outer body in the pressure chamber to effect upward outer body movement with respect to the piston to extend the at least one stabilizer and the at least one cutting blade; such a wellbore cutting tool wherein the pressure chamber is disposed so that reduction of pressure of the fluid therein permits the spring to move the outer body downwardly with respect to the piston to effect return of the at least one stabilizer and the at least one cutting blade to a non-extended position on the outer body; such a wellbore cutting tool wherein the piston is pullable upwardly following extension of the at least one stabilizer and of the at least one cutting blade to return the at least one stabilizer and the at least one cutting blade to a non-extended position on the outer body; such a wellbore cutting tool with a stabilizer recess in the outer body corresponding to and for initially receiving each at least one stabilizer; such a wellbore cutting tool with a blade recess in the outer body corresponding to and for receiving each at least one cutting blade; such a wellbore cutting tool with a downhole motor interconnected with the wellbore cutting tool for rotating the wellbore cutting tool to cut the tubular member; such a wellbore cutting tool with an expansion joint connected between the downhole motor and the wellbore cutting tool; such a wellbore cutting tool wherein the at least one stabilizer is spaced-apart from and mounted to the outer body above the at least one cutting blade; such a wellbore cutting tool wherein the piston has at least one flat surface, and at least one set screw extending through the outer body to abut the at least one flat surface on the piston to prevent rotation of the piston; such a wellbore cutting tool suitable for use as a through-tubing cutting tool, the wellbore cutting tool having an outside diameter of 3.75inches or less; and a wellbore cutting tool with a piston having a fluid flow bore therethrough, at least one stabilizer kick-out member, and at least one cutting blade kick-out member, an outer body through which the piston projects, the outer body movable about the piston, the outer body having at least one stabilizer pivotably mounted thereto, the at least one stabilizer movable out from the outer body upon movement of the outer body with respect to the piston so that the at least one stabilizer contacts the at least one stabilizer kick-out member, said contact effecting extension of the at least one stabilizer out from the outer body, the outer body having at least one cutting blade for cutting a tubular member in which the wellbore cutting tool is positionable, the at least one cutting blade pivotably mounted to the outer body, the at least one cutting blade movable out from the outer body upon movement of the outer body with respect to the piston so that the at least one cutting blade contacts the at least one cutting blade kick-out member, said contact effecting extension of the at least one cutting blade out from the outer body, the at least one stabilizer kick-out member positioned so that the at least one stabilizer extends from the outer body prior to cutting of the tubular member, a spring with a spring force biasing apart the piston and the outer body so that initially the outer body is prevented from moving with respect to the piston, a pressure chamber between a lower end of the piston and a lower end of the outer body, the pressure chamber in fluid communication with the fluid flow bore through the piston so that fluid under pressure is introducible into the pressure chamber at a pressure that overcomes the spring's spring force, the fluid under pressure acting on a portion of the outer body in the pressure chamber to effect upward outer body movement with respect to the piston to extend the at least one stabilizer and the at least one cutting blade, the pressure chamber disposed so that reduction of pressure of the fluid therein permits the spring to move the outer body downwardly with respect to the piston to effect return of the at least one stabilizer and the at least one cutting blade to a non-extended position on the outer body, and the piston pullable upwardly following extension of the at least one stabilizer and of the at least one cutting blade to return the at least one stabilizer and the at least one cutting blade to a non-extended position on the outer body.

It is, therefore, an object of at least certain preferred embodiments of the present invention to provide:

New, useful, unique, efficient, and wellbore cutting tools;

Such a tool with dual mechanisms for blade and stabilizer retraction;

Such a tool which can be used as a through-tubing tool;

Such a tool with one or more stabilizers which extend prior to cutting blade extension to effect good tool centralizing prior to the initiation of cutting; and Such a tool which is rotatable by a downhole motor.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this parent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1:
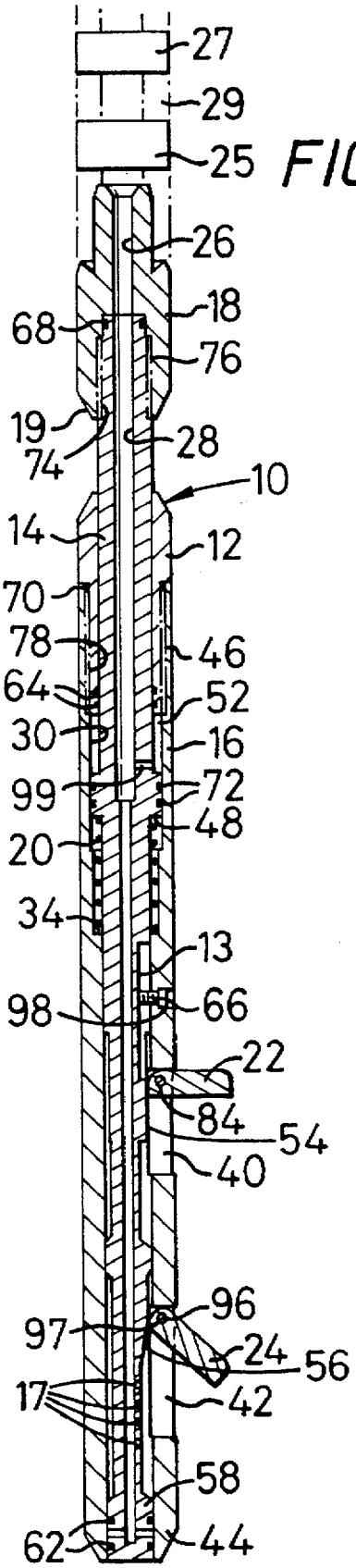
FIG. 1 is a side cross-section view of a wellbore cutting tool according to the present invention.
Figure 2:
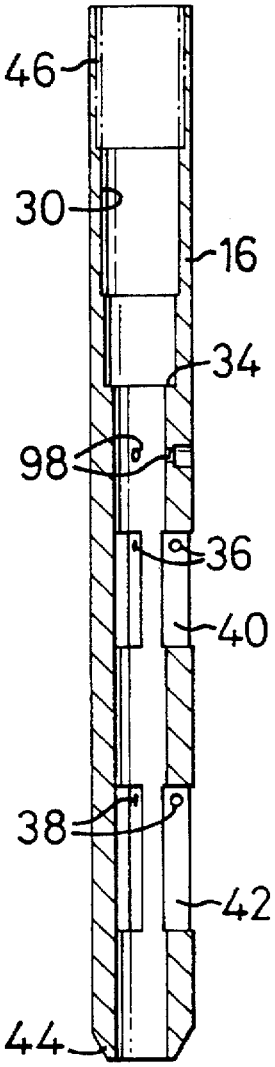
FIG. 2 is a side cross-section view of the outer body of the tool of FIG. 1.
Figure 3:
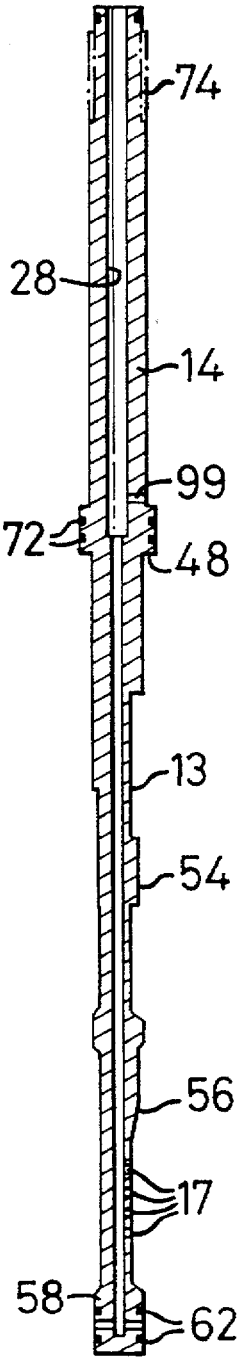
FIG. 3 is a side cross-section view of the piston of the tool of FIG. 1.
Figure 4:
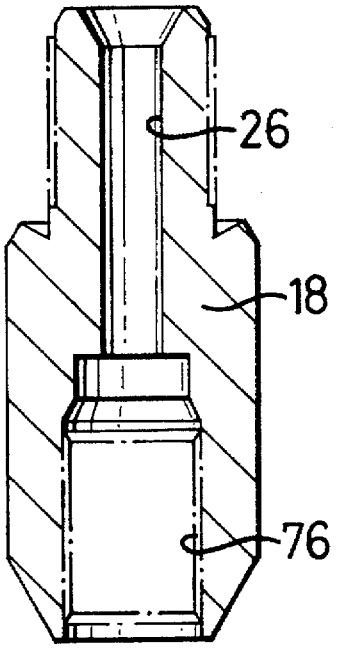
FIG. 4 is a side cross-section view of the top sub of the tool of FIG. 1.
Figure 5:
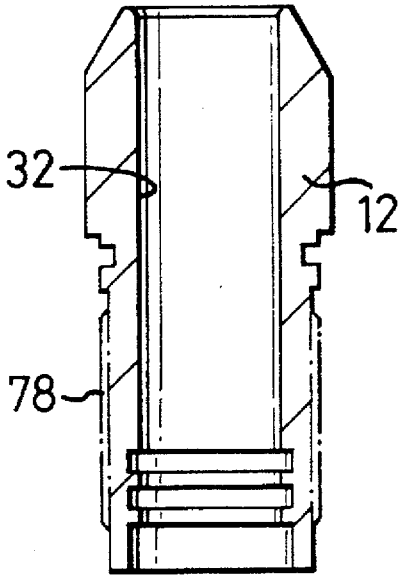
FIG. 5 is a side cross-section view of the top cap of the tool of FIG. 1.

Referring now to FIG. 1, a cutting tool 10, has: an outer body 16 with a bore 30 therethrough and threadedly connected at the top by its threads 46 to a top cap 12 with its threads 78 and a seal 70 sealing the outer-body-top-cap interface; a central piston 14 with its threads 74 threadedly mating with threads 76 of a top sub 18 and a seal 68 sealing the top-sub-central-piston interface; and a spring 20 biased against a shoulder 48 on the central piston 14 and a shoulder 34 on the outer body 16 urging the outer body 16 downwardly with respect to the central piston 14. FIG. 1 shows schematically an expansion joint 25 positioned in a string 29 between the cutting tool 10 and a downhole motor 27 that is used, in one aspect, to rotate the cutting tool 10.

A plurality of (e.g. two, three or more) stabilizers 22 (three in the tool 10) are pivotably connected to the outer body 16 by a pin extending through a hole 84 in the stabilizer and a hole 36 in the outer body. Another pin may be inserted through a hole in the pivot pins to secure them in place or through a half-moon recesses in the pivot pin. In one preferred embodiment the stabilizers reside wholly (or substantially) within recesses 40 in the outer body 16 and do not project or extend therefrom. In through-tubing operations this facilitates insertion of the tool through relatively small inner diameter tubulars (e.g., in certain aspects, as small as 1.8 inches with the tool outer diameter with stabilizers non-extended of about 1.75 inches or a tool with an outer diameter of 2.125 inches in tubing with an inner diameter of 2.25 inches).

A plurality of cutting blades 24 (e.g. three in the tool 10) are pivotably connected to the outer body 16 by pivot pins 96 extending through a hole 97 in each blade 24 and a hole 38 in the outer body 16. In one preferred embodiment the blades 24 reside wholly (or substantially) within recesses 42 in the outer body 16.

Fluid under pressure may be introduced into the tool 10 from the surface through a tubular string 29 (e.g. drill pipe, coiled tubing, tubing, or casing), through the bore 26 of the top sub 18, through a bore 28 of the central piston 14, through a piston port 99, and into a chamber 52 defined by walls of the central piston 14 and the outer body 16 and a lower end of the top cap 12. Seals 72 seal the central-piston-outer-body interface below the chamber 52. Seals 62 seal this interface at the bottom of the tool between a lower end 58 of the central piston 14 and a lower end 44 of the outer body 16.

Set screws 66 (three in the tool, one shown) in holes 98 in the outer body 16 are screwed in to abut flat surfaces 13 on the central piston 14 to prevent rotation of the central piston Fluid under pressure provided, e.g. by a pump system at the surface enters the chamber 52 pushing the top cap 12 and the outer body 16 up against the force of the spring 20. As the outer body 16 moves up with respect to the central piston 14, each stabilizer contacts a kick-out member 54 and is pivoted outwardly from the tool 10. Due to the spacing between the kick-out members 54 and kick-out members 56, the stabilizers 22 extend before extension of the blades 24.

As shown in FIG. 1, the stabilizers 22 are fully extended while the blades 24, moving on the kick-out members 56, are still extending. Shortly after the position of FIG. 1, the blades 24 are also fully extended (horizontal with respect to the outer body).

Figure 6:
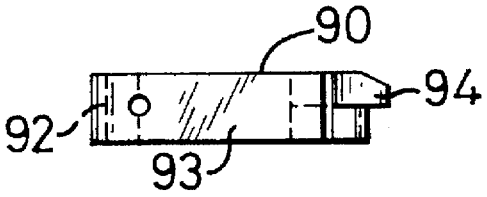
FIG. 6 is a is a top view of a cutting blade for a tool according to the present invention.
Figure 7:
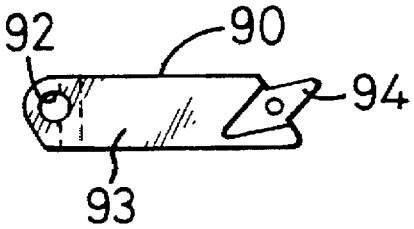
FIG. 7 is a side view of the blade of FIG. 6.

A plurality (one or more) of fluid wash ports 17 allow fluid under pressure from within the central piston 14 to wash the blades 24 as they cut. Preferably at least one wash port is associated with and adjacent each blade. A lower end 19 of the top sub provides a stop to limit upward movement of the top cap 12 and the outer body FIGS. 6 and 7 show a cutting blade 90 for use as a blade 24 in the tool 10. The cutting blade 90 has a body 93 with a mounting hole 92 and a cutting insert 94 which is either bolted to the blade 90 or welded thereto. One or more inserts may be used.

Figure 8:
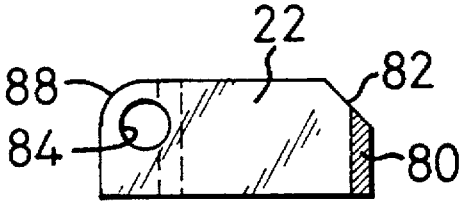
FIG. 8 is a side view of a stabilizer of the tool of FIG. 1.

FIG. 8 shows a stabilizer 22 with a curved portion 88, a beveled top edge 82, and an outer end 80 (dressed e.g. with brass).

In one aspect a cutter as in FIG. 1 has an outside diameter with stabilizers and blades within the tool body (non-extended) of: no greater than 3.750 inches; about 3.75 inches; or about 2.06 inches. In an embodiment with an outer diameter of about 2.06 inches the cutting blades extend a maximum of about 3.75 inches from the tool body when horizontal with respect to the tool body.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. § 112.

What is claimed is:

1. A wellbore cutting tool comprising a piston having a fluid flow bore therethrough, at least one stabilizer kick-out out member, and at least one cutting blade kick-out member, an outer body through which the piston projects, the outer body movable about the piston, the outer body having at least one stabilizer pivotably mounted thereto, the at least one stabilizer movable out from the outer body upon movement of the outer body with respect to the piston so that the at least one stabilizer contacts the at least one stabilizer kick-out member, said contact effecting extension of the at least one stabilizer out from the outer body, and the outer body having at least one cutting blade for cutting a tubular member in which the wellbore cutting tool is positionable, the at least one cutting blade pivotably mounted to the outer body, the at least one stabilizer spaced-apart from and mounted to the outer body above the at least one cutting blade, the at least one cutting blade movable out from the outer body upon movement of the outer body with respect to the piston so that the at least one cutting blade contacts the at least one cutting blade kick out member, said contact effecting extension of the at least one cutting blade out from the outer body.

2. The wellbore cutting tool of claim 1 wherein the at least one stabilizer is three spaced-apart stabilizers, and the at least one cutting blade is three spaced-apart cutting blades.

3. The wellbore cutting tool of claim 1 further comprising at least one wash port through the piston adjacent each blade of the at least one cutting blade for directing fluid at said blade.

4. The wellbore cutting tool of claim 1 wherein the at least one stabilizer kick-out member is positioned so that the at least one stabilizer extends from the outer body prior to cutting of the tubular member.

5. The wellbore cutting tool of claim 1 further comprising a spring with a spring force biasing apart the piston and the outer body so that initially the outer body is prevented from moving with respect to the piston.

6. The wellbore cutting tool of claim 5 further comprising a pressure chamber in fluid communication with the fluid flow bore through the piston so that fluid under pressure is introducible into the pressure chamber at a pressure that overcomes the spring's spring force, the fluid under pressure acting on a portion of the outer body in the pressure chamber to effect upward outer body movement with respect to the piston to extend the at least one stabilizer and the at least one cutting blade.

7. The wellbore cutting tool of claim 6 further comprising the pressure chamber disposed so that reduction of pressure of the fluid therein permits the spring to move the outer body downwardly with respect to the piston to effect return of the at least one stabilizer and the at least one cutting blade to a non-extended position on the outer body.

8. The wellbore cutting tool of claim 1 further comprising the piston pullable upwardly following extension of the at least one stabilizer and of the at least one cutting blade to return the at least one stabilizer and the at least one outing blade to a non-extended position on the outer body.

9. The wellbore cutting tool of claim 1 further comprising a stabilizer recess in the outer body corresponding to and for initially receiving each at least one stabilizer.

10. The wellbore cutting tool of claim 1 further comprising a blade recess in the outer body corresponding to and for receiving each at least one cutting blade.

11. The wellbore cutting tool of claim 1 further comprising a downhole motor interconnected with the wellbore cutting tool for rotating the wellbore cutting tool to cut the tubular member.

12. The wellbore curing tool of claim 1 further comprising an expansion joint connected between the downhole motor and the wellbore cutting tool.

13. The wellbore cutting tool of claim 1 further comprising the piston having at least one flat surface, and at least one set screw extending through the outer body to abut the at least one flat surface on the piston to prevent rotation of the piston.

14. The wellbore cutting tool of claim 1 suitable for use as a through-tubing cutting tool, the wellbore curing tool having an outside diameter of 3.75 inches or less.

15. A wellbore cutting tool comprising a piston having a fluid flow bore therethrough, at least one stabilizer kick-out member, and at least one cutting blade kick-out member, an outer body through which the piston projects, the outer body movable about the piston, the outer body having at least one stabilizer pivotably mounted thereto, the at least one stabilizer movable out from the outer body upon movement of the outer body with respect to the piston so that the at least one stabilizer contacts the at least one stabilizer kick-out member, said contact effecting extension of the at least one stabilizer out from the outer body, the outer body having at least one cutting blade for cutting a tubular member in which the wellbore cutting tool is positionable, the at least one cutting blade pivotably mounted to the outer body, the at least one cutting blade movable out from the outer body upon movement of the outer body with respect to the piston so that the at least one cutting blade contacts the at least one cutting blade kick-out member, said contact effecting extension of the at least one cutting blade out from the outer body, the at least one stabilizer kick-out member positioned so that the at least one stabilizer extends from the outer body prior to cutting of the tubular member, and the at least one stabilizer kick out member and the at least one cutting blade kick-out member positioned such that the at least one stabilizer moves to a full stabilizing position prior to movement of the at least one cutting blade to a full cutting position.

16. A wellbore cutting tool comprising a piston having a fluid flow bore therethrough, at least one stabilizer kick-out member, and at least one cutting blade kick-out member, an outer body through which the piston projects, the outer body movable about the piston, the outer body having at least one stabilizer pivotably mounted thereto, the at least one stabilizer movable out from the outer body upon movement of the outer body with respect to the piston so that the at least one stabilizer contacts the at least one stabilizer kick-out member, said contact effecting extension of the at least one stabilizer out from the outer body, the outer body having at least one cutting blade for cutting a tubular member in which the wellbore cutting tool is positionable, the at least one cutting blade pivotably mounted to the outer body, the at least one cutting blade movable out from the outer body upon movement of the outer body with respect to the piston so that the at least one curing blade contacts the at least one cutting blade kick-out member, said contact effecting extension of the at least one cutting blade out from the outer body, the at least one stabilizer kick-out member positioned so that the at least one stabilizer extends from the outer body prior to cutting of the tubular member, the at least one stabilizer kick out member and the at least one cutting blade kick-out member positioned such that the at least one stabilizer moves to a full stabilizing position prior to movement of the at least one cutting blade to a full cutting position, a spring with a spring force biasing apart the piston and the outer body so that initially the outer body is prevented from moving with respect to the piston, a pressure chamber in fluid communication with the fluid flow bore through the piston so that fluid under pressure is introducible into the pressure chamber at a pressure that overcomes the spring's spring force, the fluid under pressure acting on a portion of the outer body in the pressure chamber to effect upward outer body movement with respect to the piston to extend the at least one stabilizer and the at least one cutting blade, the pressure chamber disposed so that reduction of pressure of the fluid therein permits the spring to move the outer body downwardly with respect to the piston to effect return of the at least one stabilizer and the at least one cutting blade to a nonextended position on the outer body, and the piston pullable upwardly following extension of the at least one stabilizer and of the at least one cutting blade to return the at least one stabilizer and the at least one cutting blade to a non-extended position on the outer body.

* * * * *